United States Patent [19]

Nakajima et al.

[11] Patent Number: 4,950,451

[45] Date of Patent: Aug. 21, 1990

[54] COPPER ALLOY FOR AN ELECTRONIC DEVICE AND METHOD OF PREPARING THE SAME

[75] Inventors: Takashi Nakajima; Kenji Kubozono, both of Sagamihara; Takefumi Itou; Kimio Hashizume, both of Amagasaki; Shinichi Iwase, Sagamihara, all of Japan

[73] Assignee: Mitsubishi Denki Kabushiki Kaisha, Tokyo, Japan

[21] Appl. No.: 326,645

[22] Filed: Mar. 21, 1989

[30] Foreign Application Priority Data

| | | | |
|---|---|---|---|
| Mar. 23, 1988 | [JP] | Japan | 63-68512 |
| Sep. 20, 1988 | [JP] | Japan | 63-235372 |
| Oct. 20, 1988 | [JP] | Japan | 63-262875 |

[51] Int. Cl.[5] ..... C22C 9/06

[52] U.S. Cl. ..... 420/481; 420/485

[58] Field of Search ..... 420/472, 473, 481, 485, 420/494, 499

[56] References Cited

U.S. PATENT DOCUMENTS

| | | | |
|---|---|---|---|
| 2,460,991 | 2/1949 | LeBrasse et al. | 420/473 |
| 4,666,667 | 5/1987 | Kamio et al. | 420/473 |

FOREIGN PATENT DOCUMENTS

| | | | |
|---|---|---|---|
| 2509892 | 9/1976 | Fed. Rep. of Germany | 420/481 |
| 245753 | 12/1985 | Japan | 420/472 |
| 245754 | 12/1985 | Japan | 420/472 |
| 147832 | 7/1986 | Japan | 420/481 |

*Primary Examiner*—Theodore Morris
*Assistant Examiner*—George Wyszomierski
*Attorney, Agent, or Firm*—Oblon, Spivak, McClelland, Maier & Neustadt

[57] ABSTRACT

A copper alloy for an electronic device comprises 1.0 wt %–4.0 wt % of Ni, more than 0.2 wt % and less than 0.8 wt % of P, 0.5 wt %–6.0 wt % of Zn and the rest being copper and unavoidable impurities. The rest may include 0.05 wt %–1.0 wt % of Mg.

A wire of the above-mentioned copper alloy is prepared by heating the copper alloy having the composition described above at temperature of 750° C.–950° C. for more than one minute before the final rolling operation, and then, heating the material at a temperature of 350° C.–500° C., or slowly cooling it at a rate of 4° C./min. or less, or cooling it at a rate of 1° C./min. or more until temperature reaches 500° C. and keeping its temperature for at least one hour in a temperature range of 500° C.–350° C.

1 Claim, No Drawings

COPPER ALLOY FOR AN ELECTRONIC DEVICE AND METHOD OF PREPARING THE SAME

BACKGROUND OF THE INVENTION

1. Field of the Invention

The present invention relates to a copper alloy material preferably used for an electric conductive material for various kinds of electronic devices and a method of preparing the same.

2. Discussion of Background

There has been well known to use e.g. a brass series alloy or a phosphor bronze series alloy which has been practically used for various fields such as connectors.

As characteristics required for materials for electronic devices, they should have a mechanical strength such as a tensile strength of about 50 kgf/mm$^2$ as well as the same electric conductivity and anti-corrosion properties as the phosphor bronze. In recent years, however, demands for miniaturization, a high performance and utility in various circumstances are increasing for the electronic, devices, and therefore, materials having accuracy and reliability are required. Further, cost for producing the materials should be low.

As an example of such demands, a material having a high electric conductivity, heat resistance properties and a low sensitivity to a migration phenomenon is required while the electronic devices should be miniaturized and should possess a high performance. Brass which has been used as an alloy for electronic devices has disadvantages of low mechanical strength and a large sensitivity to stress-corrosion; cracking although the brass has excellent migration resistance properties and is inexpensive. As to a phosphor bronze series alloy, although it has a sufficient mechanical strength and anti corrosion properties, it is not always satisfactory with respect to electric conductivity, the sensitivity to migration resistance and thermal resistance properties when it is used for a highly advanced electronic device. Further, a material made of phosphor bronze used for an electronic device is relatively expensive since it contains tin as the major component.

SUMMARY OF THE INVENTION

It is an object of the present invention to provide a copper alloy material for an electronic device which is suitably used for a highly advanced electronic device and can be produced at a low manufacturing cost, and a method of preparing the copper alloy material having the abovementioned advantages.

In accordance with the present invention, there is provided a copper alloy for an electronic device which comprises 1.0 wt %–4.0 wt % of Ni, more than 0.2 wt % and less than 0.8 wt % of P, 0.5 wt %–6.0 wt % of Zn and the rest being copper and unavoidable impurities.

In accordance with the present invention, there is provided copper alloy for an electronic device which comprises 1.0 wt %–4.0 wt % of Ni, more than 0.2 wt % and less than 0.8 wt % of P, 0.5 wt %–6.0 wt % of Zn, 0.05 wt %–1.0 wt % of Mg and the rest being copper and unavoidable impurities.

In accordance with the present invention, there is provided a method of preparing a copper alloy material for an electronic device which comprises:

a first step of heat-treating a copper alloy comprising 1.0 wt %–4.0 wt % of Ni, more than 0.2 wt % and less than 0.8 wt % of P, 0.5 wt %–6.0 wt % of Zn and the rest being copper and unavoidable impurities at a temperature of 750° C.–950° C. for more than 1 minute before the final rolling operation for finishing, and a second step of heat-treating said copper alloy hat-treated at the first step at a temperature of 350° C.–500° C.

In accordance with the present invention, there is provided a method of preparing a wire of copper alloy for an electronic device which comprises:

a first step of heating a copper alloy comprising 1.0 wt %–4.0 wt % of Ni, more than 0.2 wt % and less than 0.8 wt % of P, 0.5 wt %–6.0 wt % of Zn, 0.05 wt %–1.0 wt % of Mg and the rest being copper and unavoidable impurities at a temperature of 750° C.–950° C. for more than 1 minute before the final rolling operation for finishing, followed by quenching it in water or oil, and a second step of heating said quenched copper alloy at a temperature of 350° C.–500° C. for more than 10 minutes.

In accordance with the present invention, there is provided a method of preparing a wire of copper alloy for an electronic device which comprises:

heating a copper alloy comprising 1.0 wt %–4.0 wt % of Ni, more than 0.2 wt % and less than 0.8 wt % of P, 0.5 wt %–6.0 wt % of Zn, 0.05 wt %–1.0 wt % of Mg and the rest being copper and unavoidable impurities at a temperature of 750° C.–950° C. for more than 1 minute before the final rolling operation for finishing, and slowly cooling the copper alloy at a rate of 4° C./min. or less.

In accordance with the present invention, there is provided a method of preparing a wire of copper alloy for an electronic device which comprises:

heating a copper alloy comprising 1.0 wt %–4.0 wt % of Ni, more than 0.2 wt % and less than 0.8 wt % of P, 0.5 wt %–6.0 wt % of Zn, 0.05 wt %–1.0 wt % of Mg and the rest being copper and unavoidable impurities at a temperature of 750° C.–950° C. for more than 1 minute before the final rolling operation for finishing; cooling said heated copper alloy at a rate of 1° C./min. or omre until the temperature reaches 500° C., and keeping its temperautre or slowly cooling the copper alloy for at least one hour in a temperature range of 500° C.–350° C.

In the copper alloy as described above, when the content of Ni is less than 1.0 wt %, the mechanical strength of thus obtained copper alloy material is insufficient. On the other hand, when it exceeds 4.0 wt %, electric conductivity will be decreased.

When the content of P is 0.2 wt % or less, the production of an intermetallic compound is small whereby a sufficient strength can not be obtained. On the other hand, when it exceeds 0.8 wt %, processability and electric conductivity will decrease.

When the content of Zn is less than 0.5 wt %, effect for suppressing a migration phenomenon becomes insufficient. On the other hand, when it is more than 6.0 wt %, the electric conductivity becomes small and the sensitivity to stress-corrosion cracking becomes large. Magnesium also provides a remarkable improvement of anti migration as well as Zn. Mg can further improve the mechanical strength and electric conductivity by reacting with phosphor in the copper alloy to form a compound. The upper limit of Mg is determined in consideration of ease of casting and processability.

A preferred method of preparing the copper alloy is, for instance, to melt and cast metallic materials in a radiofrequency electric furnace so that a copper alloy having the above-mentioned formulation is obtained, and to shave and roll the cast copper alloy into a plate-like product, if necessary.

Thus obtained copper alloy is heated at a temperature 750° C.–950° C. for more than one minutes, before the final rolling operation for finishing as a first step. For the heat teatment, it is necessary to carry out the step under a non-oxdizing atmosphere, for instance, in Ar, $N_2$ or $H_2$ or a gas mixture consisting of at least two kinds of gases, although the heat treatment can be carried out in air. The first step of the heat treatment corresponds to a so-called solid solution treatment for an age hardening alloy. When a temperature for heating is less than 750° C., a sufficient strength of alloy can not be obtained. On the other hand, when it exceeds 950° C., the melting of the alloy begins. Further, when a time for heating is less than one minute, the object of the solid soltion treatment can not be satisfactorily obtained. After the heat treatment as the first step, the copper alloy may be sujected to a rolling operation.

A heat treatment is carried out at a temperature of 350° C.–500° C. as a second step after the first step has finished. This step is to effect a so-called ageing treatment. When a temperature for heating is out of that range, the strength and the conductivity become insufficient. A preferred time for the heat treatment for the second step will be described.

Various steps may be taken between the first and second steps. Preferably, the copper alloy heated at the first step is quenched by immersing it in, for instance, water or oil. In this case, it is desirable that the heat treatment as the second step is carried out to heat the copper alloy at a temperature of 350° C.–500° C. for more than ten minutes irrespective of cold working being conducted. When the time for heat treatment is less than 10 minutes, the strength of the alloy is insufficient. The second step may be repeated several times.

As a preferred method of preparing the copper alloy material for an electronic device, the copper alloy is slowly cooled at a rate of 4° C./minute or less after the first heat treatment. In this case, the copper alloy is not subjected to a quenching step. However, the slowly cooling step also serves the second step in which the copper alloy is heated in a temperature range of 500° C.–300° C. Such operation provides a great advantage because a continuous treatment becomes possible. When the temperature reducing rate is faster than the abovementioned rate (4° C./minute or less), the strength of the copper alloy material is insufficient. This method provides the same effect as the above-mentioned method. Further, this method can simplify the manufacturing steps.

At another preferable method, the copper alloy which has been subjected to the first step is cooled at a rate of 1° C./minute or more until the temperature reaches 500° C., and keeps the temperature or slowly cool the copper alloy for more than one hour in a temperature range of 500° C.–350° C. This method features combining the two methods just mentioned above, and this method allows a continuous treatment, and only one heat treatment is sufficient in the same manner as the abovementioned method. When the cooling rate is less than 1° C./minutes, until the temperature reaches 500° C., sufficient characteristics can not be obtained. Further, much time is needed. When the time for heat treatment as the second step is less than one hour, the strength of the copper alloy material is insufficient.

The copper alloy material obtained by the abovementioned methods of the present invention has a high tensile strength and excellent electric conductivity as well as excellent corrosion resistance properties. The copper alloy material of the present invention is widely applicable to structural elements for electronic devices and appliances such as lead frames for semiconductor, connectors and so on, and allows the electronic devices to reduce the size. Further, it makes the devices reliable.

In the following, preferred examples of the present invention will be described.

EXAMPLE 1

Samples (No. 1–No. 11) having the formulations as in Table 1 were prepared as follows. Each ingot (Sample Nos. 1–11) was prepared by a lateral continuous casting method from a radiofrequency electric furnace. The ingots were repeatedly subjected to cold rolling and heat treating operations whereby they were shaped into plate-like bodies having a thickness of 0.25 mm in a state of a final working rate of 37%. As a heat treatment before the final rolling operation for finishing, the ingots are heated at 800° C. for 30 minutes followed by quenching them in water. After the final rolling operation for finishing, a tempering treatment was conducted at 450° C. for two hours. Evaluation of various characteristics was made for each sample.

Table 1 shows the various characteristics of the samples of the present invention and comparative samples.

TABLE 1

| Sample No. | Composition Ni | P | Zn | Sn | Cu | Tensile strength (kgf/mm²) | Electric conductivity (% IACS) | Sensitivity to stress-corrosion cracking Time for breaking (hr)(1) | Sensitivity to migration Time for short circuitting (sec)(2) | Remark |
|---|---|---|---|---|---|---|---|---|---|---|
| 1 | 0.83 | 0.14 | 0.64 | — | the rest | 42.8 | 71.1 | 100 or more | 103 | Comparative Samples |
| 2 | 1.54 | 0.33 | 0.21 | — | the rest | 54.3 | 67.5 | 100 or more | 85 | |
| 3 | 4.52 | 0.92 | 6.70 | — | the rest | 60.1 | 39.6 | 53 | 157 | |
| 4 | 1.12 | 0.23 | 2.64 | — | the rest | 51.1 | 65.6 | 100 or more | 114 | Present invention |
| 5 | 1.53 | 0.34 | 0.66 | — | the rest | 54.0 | 66.7 | 100 or more | 99 | |
| 6 | 1.53 | 0.34 | 2.61 | — | the rest | 52.7 | 62.1 | 100 or more | 117 | |
| 7 | 1.54 | 0.34 | 4.05 | — | the | 53.9 | 65.6 | 87 | 133 | |

TABLE 1-continued

| Sample No. | Composition Ni | P | Zn | Sn | Cu | Tensile strength (kgf/mm²) | Electric conductivity (% IACS) | Sensitivity to stress-corrosion cracking Time for breaking (hr)(1) | Sensitivity to migration Time for short circuitting (sec)(2) | Remark | |
|---|---|---|---|---|---|---|---|---|---|---|---|
| 8 | 1.54 | 0.33 | 5.73 | — | rest the rest | 54.1 | 66.9 | 83 | 149 | | |
| 9 | 3.72 | 0.71 | 4.09 | — | the rest | 56.4 | 51.3 | 87 | 137 | | |
| 10 | — | — | the rest | — | 69.98 | 46.6 | 26.3 | 4 | 137 | Comparative Samples | JIS C2600 JIS C5191 |
| 11 | — | 0.13 | — | 0.06 | the rest | 54.3 | 14.1 | 100 or more | 69 | | |

Note:
(1)Method of testing stress-corrosion to ammonium
Maximum bending stress: 30 kgf/mm² (274 MPz)
Temperature: 40° C.
Reagent: A commercially available first grade reagent diluted with an equal amount of water (a sample was placed above the reagent in a desicator)
(2)Method of testing migration
An electric circuit was formed under the condition that samples were used as electrodes and distilled water was filled between the electrodes, and a time until short circuitting took place was measured.
Distance of electrodes: 1 mm
Voltage: 14 V
Resistance of circuit: 1 kΩ

Table 1 shows that although the Sample No. 1 provides some improvement in sensitivity of migration, a level of strength is still low; the Sample No. 2 provides a sufficient strength, however, effect of suppressing the sensitivity of migration is poor. Accordingly, the Samples Nos. 1 and 2 are excluded from the scope of the present invention. As to the Sample No. 3, although it has a high level of strength and an excellent sensitivity of migration, the processability is extremely poor and the sensitivity of stress-corrosion cracking increases. Accordingly, it is excluded from the scope of the present invention. The Samples Nos. 4–9 possess excellent characteristics in strength, conductivity, anti-corrosion and sensitivity of migration.

EXAMPLE 2

Ingots for Samples Nos. 12–23 were prepared by a lateral continuous casting method from a radiofrequency electric furnace. Each of the ingots was repeatedly subjected to cold rolling and heat treating operations, whereby plate-like bodies each having a thickness of 0.25 mm in a state of a final working rate of 37% were prepared. A heat treatment before the final rolling operation for finishing was conducted by heating the samples at a temperature of 800° C. for 30 minutes followed by quenching them in water. After the final rolling operation for finishing, they were subjected to tempering operation at a temperature of 450° C. for two hours. Evaluation of the characteristics of each of the samples was made.

Table 2 shows the characteristics of the samples according to the present invention and the Comparative Samples.

In Table 2, although the Sample 12 provides some improvement in the sensitivity of migration, a level of strength is low. As to the sample No. 13, although the strength is sufficient, effect of suppressing the sensitivity of migration is poor. As to the Sample No. 14, although it exhibits as a whole excellent characteristics in strength and so on, it is difficult to apply a casting method and the processability is extremely poor because a large amount of Mg is contained. Further, a bulk production system can not be employed for the Sample No. 14. Therefore, the Samples Nos. 12–14 are excluded from the scope of the present invention.

It is clear that the Samples Nos. 15–20 according to the present invention possess excellent characteristics in strength, conductivity, anti-corrosion and sensitivity of migration.

As to the Sample No. 21, although it provides a high level of strength and an excellent sensitivity of migration, the processability is extremely poor and the sensitivity of stress-corrosion cracking increases. Accordingly, it is excluded from the present invention.

TABLE 2

| Sample No. | Composition Ni | P | Zn | Mg | Sn | Cu | Tensile strength (kgf/mm²) | Electric conductivity (% IACS) | Sensitivity to stress-corrosion cracking time for breaking (hr)(1) | Sensitivity to migration time for short circuitting (sec)(2) | Remark | |
|---|---|---|---|---|---|---|---|---|---|---|---|---|
| 12 | 0.83 | 0.14 | 0.64 | 0.27 | — | the rest | 44.3 | 72.1 | 100 or more | 108 | Comparative | |
| 13 | 1.54 | 0.33 | 0.21 | 0.02 | — | " | 54.5 | 67.5 | 100 or more | 87 | Samples | |
| 14 | 1.53 | 0.34 | 2.62 | 1.21 | — | " | 58.2 | 59.7 | 100 or more | 125 | | |
| 15 | 1.12 | 0.23 | 2.64 | 0.89 | — | " | 52.2 | 67.9 | 100 or more | 122 | Present | |
| 16 | 1.53 | 0.34 | 0.66 | 0.08 | — | " | 55.1 | 66.8 | 100 or more | 103 | invention | |
| 17 | 1.53 | 0.34 | 2.61 | 0.86 | — | " | 57.1 | 64.3 | 100 or more | 125 | | |
| 18 | 1.54 | 0.34 | 4.05 | 0.31 | — | " | 56.1 | 66.1 | 89 | 136 | | |
| 19 | 1.54 | 0.33 | 5.73 | 0.13 | — | " | 55.3 | 67.2 | 83 | 153 | | |
| 20 | 3.72 | 0.71 | 4.09 | 0.33 | — | " | 59.7 | 51.9 | 88 | 141 | | |
| 21 | 4.52 | 0.92 | 6.70 | 0.14 | — | " | 63.3 | 40.7 | 54 | 164 | Com- | — |
| 22 | — | — | the rest | — | — | 69.98 | 46.6 | 26.3 | 4 | 137 | parative | JIS C2600 |

TABLE 2-continued

| Sample No. | Composition Ni | P | Zn | Mg | Sn | Cu | Tensile strength (kgf/mm²) | Electric conductivity (% IACS) | Sensitivity to stress-corrosion cracking time for breaking (hr)(1) | Sensitivity to migration time for short circuitting (sec)(2) | Remark |
|---|---|---|---|---|---|---|---|---|---|---|---|
| 23 | — | 0.13 | | — | 6.06 | the rest | 54.3 | 14.1 | 100 or more | 69 | Samples JIS C5191 |

Note:
(1)Method of testing stress-corrosion to ammonium
Maximum bending stress: 30 kgf/mm² (274 MPz)
Temperature: 40° C.
Reagent: A commercially available first grade reagent diluted with an equal amount of water (a sample was placed above the reagent in a desicator)
(2)Method of testing migration
An electric circuit was formed under the condition that samples were used as electrodes and distilled water was filled between the electrodes, and a time until short circuitting took place was measured.
Distance of electrodes: 1 mm
Voltage: 14 V
Resistance of circuit: 1 kΩ

COMPARATIVE EXAMPLE 1

Materials which were so formulated as to have 1.53 wt % of Ni, 0.45 wt % of Zn, 0.33% of P and the rest being Cu were put in a radiofrequency electric furnace to melt them, an ingot was prepared by a lateral continuous casting method. The ingot was subjected to shaving operation to provide front and rear surfaces. Then, the ingot was subjected to a cold rolling operation to obtain a copper alloy plate having a thickness of 0.4 mm. The copper alloy plate was heated at 700° C. for one hour followed by quenching it. Then, 37% cold rolling was conducted to obtain a test piece having a thickness of 0.25 mm.

COMPARATIVE EXAMPLE 2

A test piece of copper alloy having a thickness of 0.25 mm was obtained in the same manner as the Comparative Example 1 except that the test piece is heated at 450° C. for 2 hours followed by gradually cooling it in the same heating furnace.

EXAMPLE 3

A copper alloy plate having a thickness of 0.4 mm and having the same formulation as the Comparative Example 1 was heated at 800° C. for 30 minutes followed by quenching it in water. The copper alloy plate was subjected to the same cold rolling as the Comparative Example 1 to form a copper alloy plate having a thickness of 0.25 mm. Then, it was heated at 450° C. for 2 hours and was cooled in the heating furnace to obtain a test piece.

EXAMPLE 4

A copper alloy plate having a thickness of 0.4 mm was heated at 800° C. for 30 minutes, followed by quenching it in water. Then, it was heated at 450° C. for 2 hours and was cooled in the furnace. The copper alloy plate was subjected to cold rolling to form a test piece having a thickness of 2.5 mm.

EXAMPLE 5

A copper alloy plate having a thickness of 0.4 mm was heated at 800° C. for 30 minutes. Then, it was left for 30 minutes until temperature decreased to 450° C. The copper alloy plate was kept at 450° C. for 2 hours followed by slowly cooling it in the furnace. The copper alloy plate was subjected to cold rolling to obtain a test piece having a thickness of 0.25 mm.

EXAMPLE 6

A copper alloy plate having a thickness of 0.4 mm was heated at 800° C. for 30 minutes, followed by slowly cooling. The maximum rate of cooling was 2.5°/minute. Then, the copper alloy plate was subjected to cold rolling to obtain a test piece having a thickness of 0.25 mm.

EXAMPLE 7

A copper alloy plate having a thickness of 1.5 mm was heated at 800° C. for 30 minutes, followed by quenching it in water. Then, it was subjected to cold rolling to reduce the thickness to 0.4 mm. The copper alloy plate was heated at 450° C. for 2 hours, and then, slowly cooled. Then it was subjected to cold rolling to obtain a test piece having a thickness of 0.25 mm. The tensile strength and the electric conductivity of the test pieces of the Comparative Examples 1, 2 and the Examples 3–7 were measured. Table 3 shows results.

TABLE 3

| | Tensile strength (kgf/mm²) | Electric conductivity (% IACS) |
|---|---|---|
| Comparative Example 1 | 43.3 | 31.6 |
| Comparative Example 2 | 46.6 | 35.2 |
| Example 3 | 53.8 | 65.4 |
| Example 4 | 53.2 | 64.8 |
| Example 5 | 52.3 | 65.1 |
| Example 6 | 51.3 | 65.7 |
| Example 7 | 54.2 | 65.9 |

Table 3 clearly shows that the copper alloy materials obtained by using the methods of the present invention possess a high strength and electric conductivity the copper alloy materials of the present invention exhibit excellent heat resistance and migration resistance properties.

EXAMPLES 8–12 AND COMPARATIVE EXAMPLES 3 AND 4

Cu-Ni-Zn-P-Mg alloy having the formulation as shown in Table 4 was used to form copper alloy plates by using the methods of the present invention as in Table 4. The strength and the electric conductivity of each of the copper alloy plates were measured, the value of which were compared with those of Comparative Examples.

In order to prepare test pieces, ingots were prepared by using a lateral continuous casting method from a radiofrequency electric furnace. Each of the ingots was subjected to shaving operations for its front and rear surfaces and then it was repeatedly subjected to cold rolling and heat treating operations.

In Example 8, the copper alloy plate having a thickness of 0.4 mm was heated at 800° C. for 30 minutes, followed by quenching it in water. Then, a cold rolling method was conducted to the copper alloy plate to reduce the thickness of the plate to 0.25 mm. Further, the plate was heated at 450° C. for two hours and was slowly cooled in the heating furnace.

In Example 9, after the copper alloy plate has been heated and quenched in the same manner as the Example 8, it was heated at 450° C. for 2 hours. Then, it was slowly cooled in the heating furnace and then, was subjected to cold rolling to have a thickness of 0.25 mm.

In Example 10, the copper alloy plate having a thickness of 1.5 mm was heated at 800° C. for 30 minutes, followed by quenching it in water. The plate was subjected to cold rolling to reduce the thickness to 0.4 mm. Further, it was heated at 450° C. for 2 hours, followed by slowly cooling it in the heating furnace. Then, a cold rolling method was conducted to reduce the thickness to 0.25 mm.

In Example 11, the same copper alloy plate as Example 1 was used, and was slowly cooled so that the maximum rate of cooling in the furnace after heating was 2.5°/min. Then, a cold rolling method was conducted to reduce the thickness to 0.25 mm.

In Example 12, the same copper alloy plate as Example 8 was used, and it was cooled for 30 minutes after heating until temperature reaches 450° C. The temperature was kept at 450° C. for 2 hours, and it was slowly cooled in the heating furnace. Then, a cold rolling method was conducted to reduced the thickness to 0.25 mm.

In Comparative Example 3, the copper alloy plate having a thickness of 0.4 mm was heated at 700° C. for 1 hour, followed by quenching it in water. Then, it was subjected to cold rolling to reduce the thickness to 0.25 mm.

In Comparative Example 4, the same copper alloy plate as Comparative Example 3 was used and was heated, quenched and was subjected to cold rolling in the same manner as Comparative Example 3. Then, the plate was heated at 450° C. for 2 hours and was slowly cooled in the heating furnace.

Table 4 shows results of measurement.

TABLE 4

| | Sample No. | Composition Ni | Zn | P | Mg | Cu | Condition for heat treatment | Tensile strength (kgf/mm$^2$) | Electric conductivity (% IACS) | Method according to the present invention |
|---|---|---|---|---|---|---|---|---|---|---|
| Example 8 | 8 | 1.53 | 4.05 | 0.33 | 0.31 | the rest | —0.4 mm (thickness)→800° C. × 30 min then, cooling in water→0.25 mm (thickness)→450° C. × 2 Hr then, cooling in furnace | 56.1 | 66.1 | Claim 4 |
| Example 9 | 9 | 1.53 | 4.05 | 0.33 | 0.31 | the rest | —0.4 mm (thickness)→800° C. × 30 min then, cooling in water→450° C. × 2 Hr then, cooling in furnace | 55.7 | 65.2 | Claim 4 |
| Example 10 | 10 | 1.53 | 4.05 | 0.33 | 0.31 | the rest | —1.5 mm (thickness)→800° C. × 30 min then, cooling in water→0.4 mm (thickness)→450° C. × 2 Hr then, 0.25 mm (thickness) | 56.5 | 66.8 | Claim 4 |
| Example 11 | 11 | 1.53 | 4.05 | 0.33 | 0.31 | the rest | —0.4 mm (thickness)→800° C. × 30 min then, cooling in furnace, maximum rate of cooling 2.5° C./min→0.25 mm (thickness) | 53.3 | 66.7 | Claim 6 |
| Example 12 | 12 | 1.53 | 4.05 | 0.33 | 0.31 | the rest | —0.4 mm (thickness)→800° C. × 30 min then, cooling 30 min until 450° C., keeping 450° C. for 2 Hr, and cooling in furnace | 54.4 | 65.8 | Claim 7 |
| Comparative Example 3 | 3 | 1.53 | 4.05 | 0.33 | 0.31 | the rest | —0.4 mm (thickness)→700° C. × 1 Hr then, cooling in water→0.25 mm (thickness) | 44.5 | 32.1 | — |
| Comparative Example 4 | 4 | 1.53 | 4.05 | 0.33 | 0.31 | the rest | —0.4 mm (thickness)→700° C. × 1 Hr then, cooling in water→0.25 mm (thickness)→450° C. × 2 Hr then, cooling in furnace | 48.6 | 35.7 | — |

As is clear from Table 4, the test pieces in Examples 8–12 in which methods of the present invention are employed exhibit higher strength and electric conductivity than those of the test pieces in Comparative Examples 3 and 4.

At the final rolling operation, the copper alloy material may be heated at a temperature of 150° C.–450° C. for more than 3 minutes to remove a deformation resulting from the rolling operation. It is effective to improve spring characteristics and processability of the material.

Description has been made as to the preparation of a wire of the copper alloy. However, the invention is not limited to this and is applicable to a plate, a strip or the like.

Obviously, numerous modifications and variations of the present invention are possible in light of the above teachings. It is therefore to be understood that within the scope of the appended claims, the invention may be practiced otherwise than as specifically described herein.

What is claimed is:

1. A copper alloy for an electronic device consisting essentially of 1.0 wt %–4.0 wt % of Ni, more than 0.2 wt % and less than 0.8 wt % of P, 0.5 wt %–6.0 wt % of Zn, 0.05 wt %–1.0 wt % of Mg and the rest being copper and unavoidable impurities.

* * * * *